US005791253A

United States Patent [19]

Schultheis et al.

[11] Patent Number: 5,791,253

[45] Date of Patent: Aug. 11, 1998

[54] TOY VEHICLE TRACK

[75] Inventors: Douglas Schultheis, Cumberland; Lee Spielberger, Warwick, both of R.I.

[73] Assignee: Hasbro, Inc., Pawtucket, R.I.

[21] Appl. No.: 655,455

[22] Filed: May 30, 1996

[51] Int. Cl.[6] ..... A63H 21/00

[52] U.S. Cl. ..... 104/53; 104/130.07; 238/10 E; 238/10 R; 446/444

[58] Field of Search ..... 104/130.07, 130.09, 104/53, 60; 238/10 R, 10 A, 10 F, 10 E; 446/487, 109, 433, 444

[56] References Cited

U.S. PATENT DOCUMENTS

| | | |
|---|---|---|
| 138,949 | 5/1873 | Spelman . |
| 388,743 | 8/1888 | Thompson . |
| 1,618,932 | 2/1927 | Kelly . |
| 1,659,178 | 2/1928 | Wilson . |
| 1,707,615 | 4/1929 | Hunt . |
| 1,996,647 | 4/1935 | Lane . |
| 3,084,637 | 4/1963 | Kohout . |
| 3,206,122 | 9/1965 | Frisbie et al. . |
| 3,337,985 | 8/1967 | Ryan et al. . |
| 3,540,153 | 11/1970 | Aoki . |
| 3,797,404 | 3/1974 | Barlow et al. . |
| 3,831,527 | 8/1974 | Peterson . |
| 3,913,491 | 10/1975 | Auer, Jr. et al. . |
| 3,970,309 | 7/1976 | Saio . |
| 4,148,152 | 4/1979 | Barlow et al. . |
| 4,357,877 | 11/1982 | Mariol . |
| 4,417,523 | 11/1983 | Mariol . |
| 4,504,243 | 3/1985 | Barlow et al. . |
| 4,658,731 | 4/1987 | Schumann . |
| 5,277,124 | 1/1994 | DiFonso et al. . |

*Primary Examiner*—Mark T. Le
*Attorney, Agent, or Firm*—Marshall, O'Toole, Gerstein, Murray & Borun

[57] ABSTRACT

A toy vehicle track includes a riding surface that has one or more intersections. The direction the vehicle travels through an intersection is controlled by recessed channels and raised guideways. The track includes hinged portions that enable the track to be folded and carried.

14 Claims, 3 Drawing Sheets

TOY VEHICLE TRACK

FIELD OF THE INVENTION

This invention relates generally to toy vehicle tracks and more particularly a toy vehicle track having recessed grooves and raised guide rails for steering a toy vehicle through intersections and around the track.

BACKGROUND OF THE INVENTION

Toy vehicle tracks having specialized rails to guide vehicles around the track have been in use for decades. Mariol, U.S. Pat. No. 4,357,877, for example, discloses a toy train track with a double rail construction to interact with specially designed toy train wheels for minimizing slippage and avoiding binding between the track and the wheels. Barlow, U.S. Pat. No. 4,504,243 discloses a track frame for receiving grooved tiles. The tile grooves receive guide means on a vehicle to steer the vehicle. Special wheels on the vehicle ride on raised curbs on the tiles to provide a "differential effect" for the drive axle of the vehicle to provide smooth turning, similar to Mariol. Conversely, other tracks are so simple in construction that they provide no means for steering a motorized vehicle around the track and through intersections in a predetermined pattern.

In addition to the specialized vehicles and wheels of Mariol and Barlow, their tracks require the use of numerous pieces that must be assembled, disassembled, and carried in a box or other separate container. Thus, it is desirable to have a toy vehicle track that requires no special vehicle or vehicle wheel design to steer the vehicle through intersections and around the track, and that can be folded up and carried easily by a young child.

SUMMARY OF THE INVENTION

A toy vehicle track in accordance with the present invention requires no special vehicle, wheels, or extra carrying case. All of the necessary steering and guidance means are formed in the track and the track itself can be folded up and carried by a child.

One toy vehicle track in accordance with the present invention includes: a riding surface having an intersection extending from which are a first leg, a second leg, and a third leg; and means for steering a vehicle through the intersection which includes a first recessed channel beginning in the first leg and terminating in the third leg of the riding surface intersection. The means for steering the vehicle through the intersection may include a second recessed channel beginning in the third leg and terminating in the second leg of the riding surface.

The riding surface may have a second intersection including the third leg, a fourth, and a fifth leg. In the case where a fourth leg is added, a return track can be joined to the first and fourth legs for guiding the toy vehicle between the first leg and fourth leg. When a fifth leg is added, a return track can be used to connect the second leg to the fifth leg. The return tracks can be hinged to the riding surface for easy stowing and carrying.

Another embodiment of the invention includes, a central riding surface having a first intersection from which extends a first leg, a second leg and a third leg, and a second intersection including the third leg, a fourth leg and a fifth leg; a first return track hinged to the first and fourth legs; a second return track hinged to the second and fifth legs; a first recessed channel beginning in the first leg and terminating in the third leg of the first intersection; a second recessed channel beginning in the third leg and terminating in the fifth leg of the second intersection; a third recessed channel beginning in the fourth leg and terminating in the third leg of the second intersection; and a fourth recessed channel beginning in the third leg and terminating in the second leg of the first intersection. Curved embankments parallel to the recessed channels may be used to enhance steering and reduce slippage. Ramps in the terminal ends of the recessed channels may be used for raising the vehicle wheels out of the channels gradually.

The toy vehicle track may be in the shape of a figure eight and guide rails can be used on the outer edges of the track sections to guide the vehicle from the first intersection to the second intersection and vice versa.

DETAILED DESCRIPTION OF THE DRAWINGS

Figure 1:
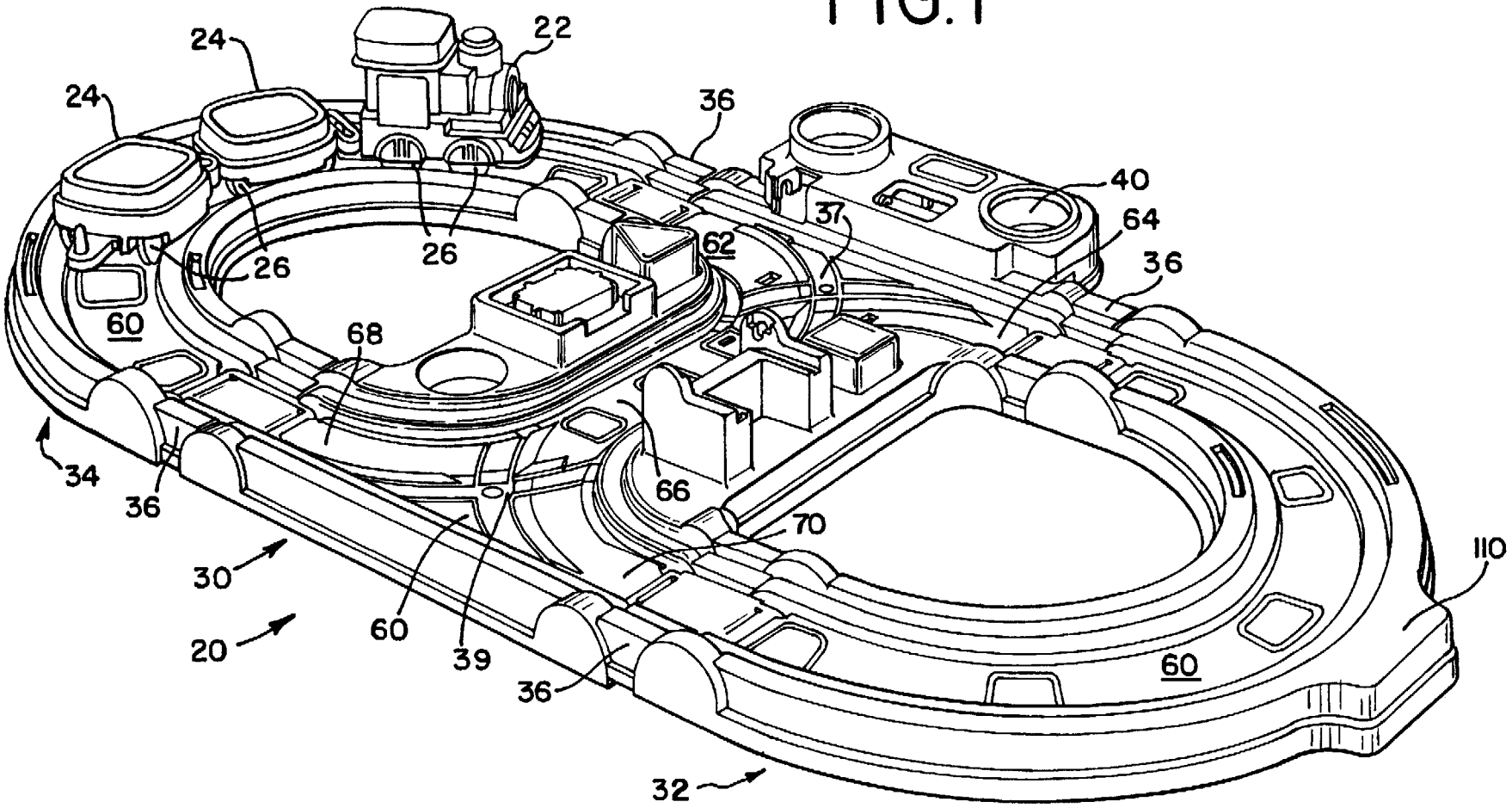
FIG. 1 is a perspective view of a toy vehicle track in accordance with the present invention.

To the extent practical, the same reference numerals will be used to identify the same elements in each of the figures.

Figure 2:
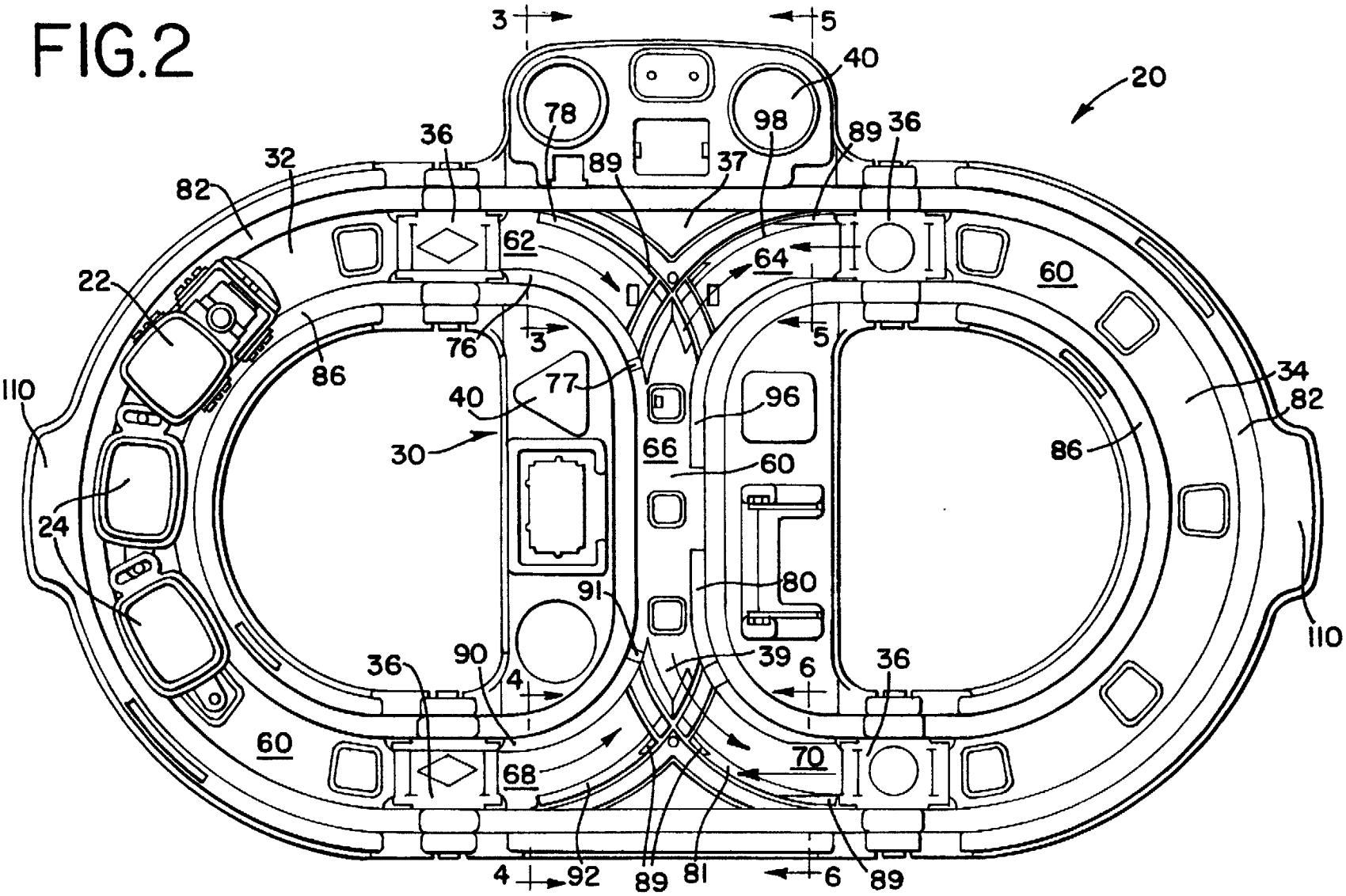
FIG. 2 is a plan view of the toy vehicle track in FIG. 1.

Referring to FIGS. 1 and 2, there is illustrated a toy vehicle track assembly 20 in accordance with the present invention supporting a manual or motorized toy train 22. The train 22 is illustrated with two trailing cars 24 and although a multi-car train is illustrated and described herein, other vehicles can be used with the inventive features of the track 20 because, as seen in cross-sectional FIGS. 3 to 6, the wheels 26 of the vehicle 22 have a simple disk shape and require no special sizing or hubs. Further, the vehicle 22 requires no steering mechanism whatsoever because it is guided around the track 20 by channels in the track 20 and guide rails extending up from the edges of the track.

The toy track vehicle assembly 20 as illustrated, includes three main sections: a central section 30, a first U-shaped return section 32, a second U-shaped return section 34; and four short hinge track sections 36. The central section 30 includes a first intersection 37 and a second intersection 39. The track sections define a figure eight-shaped track, but other track shapes and intersection shapes can be used with the present invention. Without careful study of the track's riding surface, it appears as though the train 22, without a steering mechanism, would travel around only the outside of the track and would not turn at the intersections. However, as described in detail below, the train 22 will turn or travel straight through the intersections depending on the positions of the steering channels in the track.

The central track section 30 includes a central riding surface 60 on which the wheels of the train all run. The first intersection 37 of the central riding surface 60 has a first leg 62 on the upper left, a second leg 64 on the upper right, and a third leg 66 in the middle. The second intersection 39 includes the third leg 66, a fourth leg 68 on the lower left, and a fifth leg 70 on the lower right. The arrows illustrated on the track riding surface 60 in FIG. 2 show the direction of travel for the train 22 and the means for steering the train 22 around this route is described below.

Figure 3:
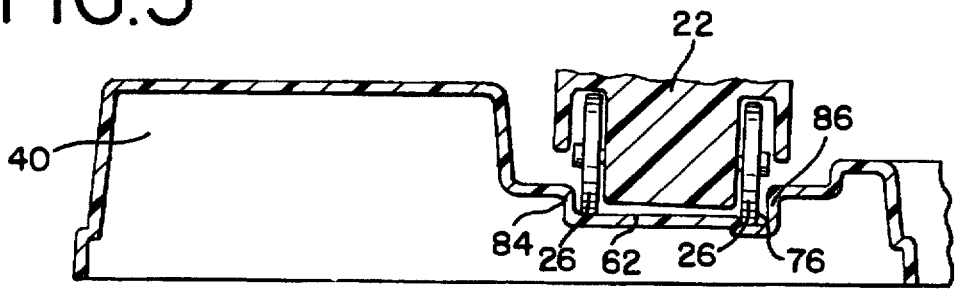
FIG. 3 is a cross-sectional view of the track taken along line 3—3 in FIG. 2.

As the train 22 travels from the first return section 32 and past a hinge section 36, it comes to the first leg 62 of the first intersection 37. The hinge section 36 and the first leg 62 include the beginning of a curved and recessed steering channel 76 which turns and terminates in the third leg 66 of the first intersection 37. A small ramp 77 at the terminal end of the steering channel 76 aids the train's wheels 26 in rising up and out of the channel 76. As seen in FIG. 3, the first steering channel 76 guides the right wheels 26 of the train 22 and prevents the vehicle 22 from traveling straight onto the second leg 64. A small curved embankment 78 parallel to the first channel 76 and spaced apart a distance that matches the wheel spacing on the train 22 may be used to support the left pair of wheels 26 to reduce slippage and improve steering.

Figure 6:
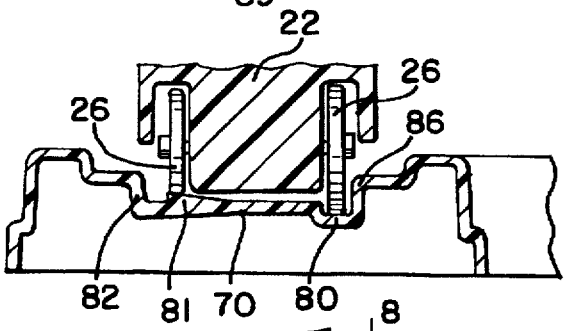
FIG. 6 is a cross-sectional view of the track taken along line 6—6 in FIG. 2.

Referring to FIGS. 2 and 6, the train 22 will then proceed along the third leg 66 until reaching the second intersection 39. A second recessed and curved steering channel 80 beginning in the third leg 66 steers the vehicle 22 left around the curve onto the fifth leg 70 of the second intersection 39 where the second steering channel 80 terminates. A curved embankment 81 parallel to the second channel 80 may be used to support to aid steering. No short ramp at the end of the second channel 80 is necessary because the second channel gradually rises so that when the train's wheels 26 reach the terminal end of the channel 80, there is only a slight bump to overcome.

When the train 22 is not being steered by channels and embankments, upwardly extending outer guide rails 82 joined to an outer edges of the track sections and an upwardly extending inner guide rail 86 joined to inner edges of the track sections guide the train 22. The combination of channels and guides in a steering means requires no special skills or practice to operate, and no complex wheel and rail structures are necessary to obtain full enjoyment from the toy.

Figure 5:
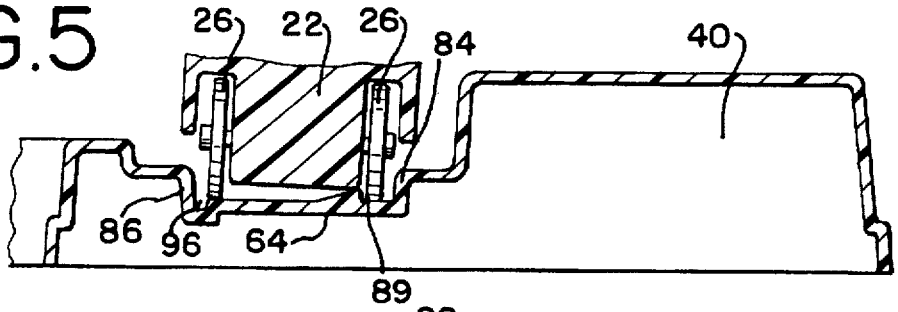
FIG. 5 is a cross-sectional view of the track taken along line 5—5 in FIG. 2.

With the raised guide rails 82 and 86, the train 22 will be guided around the second return section 34 to the second leg 64 of the first intersection 37. As illustrated in FIGS. 2 and 5, there are no recessed channels beginning in the second leg of the first intersection 37 to receive the train's wheels 26, so the train 22 will continue on a straight path onto the first leg 62 of the first intersection in a direction opposite the one it had traveled previously. When embankments are used to help steer the train 22, it is desirable to provide gaps 89 through the embankments so that the train's wheels 26 can travel smoothly. The gaps 89 can be sized to allow a relatively narrow wheel 26 to pass through the embankments when going straight, but not so wide that a relatively large diameter wheel will encounter difficulty when traveling on the embankment through a curve.

Figure 4:
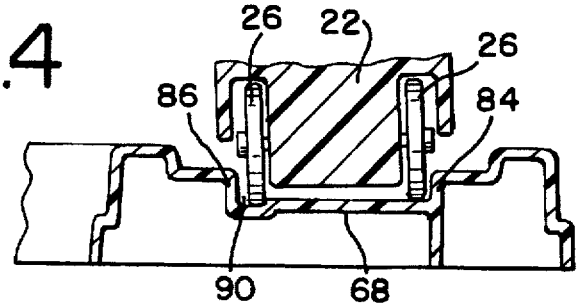
FIG. 4 is a cross-sectional view of the track taken along line 4—4 in FIG. 2.

As illustrated in FIGS. 2 and 4, after the train 22 passes straight through the first intersection 37, it will then travel around the first return section 32 through guide rails 82 and 84 onto the fourth leg 68 of the second intersection 39. The fourth leg 68 includes the beginning of a third recessed and curved steering channel 90 which terminates with a short ramp 91 in the third leg 66, as illustrated. The left train wheels 26 ride in and are steered by the third steering channel 90 as indicated by the arrows on the drawing. A third curved embankment 92 parallel to and spaced apart from the third channel 90 aids in steering the train 22, as described above.

As the train 22 continues along the third leg 66, the left wheels 26 ride out of the third steering channel 90 by rising up a small terminal ramp 91. The right wheels 26 will next encounter a fourth curved and recessed steering channel 96 beginning in the third leg 66 and terminating in the second leg 64. The fourth steering channel 96 is similar to the second steering channel 80 in that they both have no terminal ramp, and they both gradually rise so that the train wheels 26 need only overcome a small bump at the terminal end of the channel to be back on level riding surface. A fourth curved embankment 98 aids in steering.

After traveling clockwise through the second return track section 34, the train 22 rides onto the fifth leg 70 of the second intersection 39. Because the train wheels 26 encounter no recessed channels, the train 22 continues straight onto the fourth leg 68 through gaps 89 in the curved embankments and then to the first return track section 32 where it began.

Such a train and track combination will result in amusement and surprise to small children because the means for steering the train 22 is preferably molded integrally into the track's riding surface 60 and is not readily visible.

As mentioned above, the track 20 can be folded up and carried without disassembly of the track sections. This is possible using hinged track sections 36 to join the return track sections 32 and 34 to the central section 30.

Figure 7:
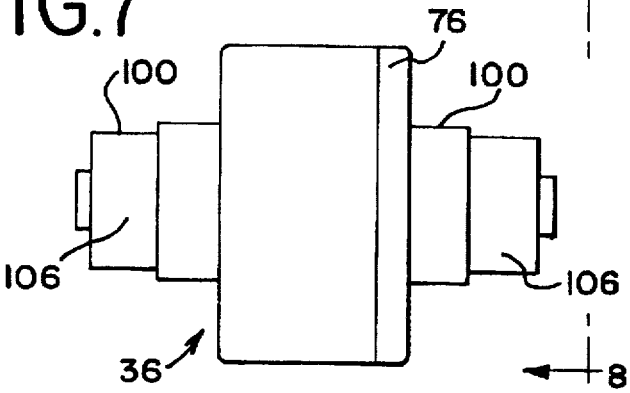
FIG. 7 is a detailed view of a hinge for joining track sections in accordance with the present invention.
Figure 8:
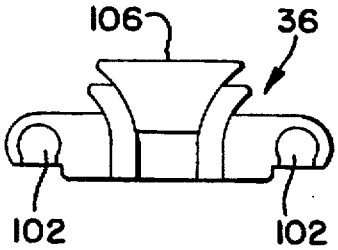
FIG. 8 is a detailed elevation view taken along line 8—8 of FIG. 7.

As viewed in FIGS. 7 and 8, the hinged track sections 36 each include two male portions 100 that fit between guide rails 82 and 84 on the central and return track sections. Thus, each hinged track section 36 includes two hinges that provide clearance for accessories mounted on the track and eliminate pinch points between track sections. The male portions 100 of the hinged track sections 36 define sockets 102 that receive mating and opposing pins (not illustrated) that extend inwardly from the guide rails 82 and 84. The sockets 102 are open at the lower edge to receive the pins by a snap fit. Hinge covers 106, preferably molded integrally in the track sections, also cover pinch points that develop between the sections as the track 20 is folded up. Carrying handles 110 are molded integrally with the return sections so that when the return sections are folded up, the handles 110 can be grasped easily. The hinged track portions 36 may include a portion of the steering channels 76 when used in close proximity to an intersection.

The above detailed description is provided for clearness of understanding only and no unnecessary limitations therefrom should be read into the following claims.

What is claimed:

1. A toy vehicle and track comprising a self-propelled vehicle having a plurality of wheels:

a riding surface supporting the wheels and having an intersection from which there extends a first leg, a second leg, and a third leg; and means for steering a vehicle through the intersection, the means fixed to the riding surface and including a first steering channel recessed below the riding surface and beginning in the first leg and terminating in the third leg of the intersection for engaging at least one of said wheels of the vehicle and steering the vehicle from the first leg to the third leg of the riding surface.

2. The toy vehicle track of claim 1 in which the means for steering a vehicle further comprises:

a second steering channel fixed to the riding surface beginning in the third leg and terminating in the second leg of the intersection for engaging a wheel of the vehicle and steering the vehicle from the third leg to the second leg of the riding surface.

3. The toy vehicle track of claim 2 in which the riding surface further comprises:

a second intersection from which there extends the third leg and a fourth leg; and means for steering a vehicle through the second intersection, the means including a third steering channel beginning in the fourth leg and terminating in the third leg of the second intersection.

4. The toy vehicle track of claim 2 in which the riding surface further comprises:

a second intersection from which there extends the third leg, a fourth leg, and a fifth leg; and means for steering a vehicle through the second intersection, the means including a fourth steering channel beginning in the third leg and terminating in the fifth leg of the second intersection.

5. The toy vehicle track of claim 3 and further comprising:

a return track section joined to the first leg of the first intersection and the fourth leg of the second intersection.

6. The toy vehicle of claim 4 and further comprising:

a return track section joined to the second leg of the first intersection and the fifth leg of the second intersection.

7. The toy vehicle of claim 5 and further comprising:

a hinge for joining the return track section to the first and fourth legs.

8. The toy vehicle of claim 6 and further comprising:

a hinge for joining the return track section to the second and fifth legs.

9. The toy vehicle of claim 5 in which the return track section comprises:

upward guide rails joined to edges of the return track section for guiding a vehicle around the return track section.

10. The toy vehicle track of claim 6 in which the return track section comprises:

upward guide rails joined to the return track sections for guiding a vehicle around the return track section.

11. The toy vehicle track of claim 1 in which the means for steering the vehicle further comprises:

a curved embankment spaced apart from and parallel to the channel.

12. A toy vehicle track comprising:

a central riding surface having a first intersection from which there extends a first leg, a second leg and a third leg, and a second intersection from which there extends the third leg, a fourth leg and a fifth leg;

a first return track section hinged to the first and fourth legs;

a second return track section hinged to the second and fifth legs;

a first steering channel beginning in the first leg and terminating in the third leg of the first intersection;

a second steering channel beginning in the third leg and terminating in the fifth leg of the second intersection;

a third steering channel beginning in the fourth leg and terminating in the third leg of the second intersection; and a fourth steering channel beginning in the third leg and terminating in the second leg of the first intersection.

13. The toy vehicle track of claim 12 and further comprising:

upward guides joined to edges of the first and second return track sections for guiding a toy vehicle around the return track sections.

14. The toy vehicle of claim 13 and further comprising:

a first curved embankment spaced apart from and parallel to the first steering channel;

a second curved embankment spaced apart from and parallel to the second steering channel;

a third curved embankment spaced apart from and parallel to the third steering channel; and a fourth curved embankment spaced apart from and parallel to the fourth steering channel.

* * * * *